United States Patent [19]

Megowen

[11] 3,998,349

[45] Dec. 21, 1976

[54] CLOSURE MEANS

[76] Inventor: William J. Megowen, Russell St., Carlisle, Mass. 01741

[22] Filed: Mar. 16, 1972

[21] Appl. No.: 235,261

Related U.S. Application Data

[62] Division of Ser. No. 123,167, March 11, 1971, Pat. No. 3,733,771.

[52] U.S. Cl. ..... 215/231; 215/341; 215/355; 215/364

[51] Int. Cl.[2] ..... B65D 51/26; B65D 53/00

[58] Field of Search ..... 215/37, 38 R, 39, 41, 215/48, 56, 231, 341, 355, 364; 99/171 B

[56] References Cited

UNITED STATES PATENTS

| | | | |
|---|---|---|---|
| 2,582,489 | 1/1952 | Krueger | 215/38 R |
| 2,693,892 | 11/1954 | Guinet | 215/41 |
| 3,247,992 | 4/1966 | Exton | 215/41 |

FOREIGN PATENTS OR APPLICATIONS

| | | | |
|---|---|---|---|
| 627,238 | 1/1963 | Belgium | 215/38 R |

*Primary Examiner*—William Price
*Assistant Examiner*—Stephen Marcus
*Attorney, Agent, or Firm*—Russell & Nields

[57] ABSTRACT

A closure for fragile containers of gassy liquids having a depending volumetric member extending down into the interior of the container to displace free gas from within the container, thereby substantially reducing or completely eliminating the chance of an explosion should the container be broken. The member occupies a volume such that when the container is filled with a usual amount of liquid either all free gas is purged by introducing the member or a small volume of free gas is left not exceeding the amount by which the liquid will expand if heated to the highest temperature normally expected to be encountered in use. The member is either a hollow, flexible walled body or composed of a cellular foam so as to be compressible under liquid thermal expansion forces to relieve excess pressure on the container, or is a hollow body provided with a small opening to admit liquid under expansionary pressures. The container is sealed by the member either in cooperation or in unitary construction with a cap.

5 Claims, 6 Drawing Figures

CLOSURE MEANS

This is a division of application Ser. No. 123,167, filed Mar. 11, 1971, now U.S. Pat. No. 3,733,771.

BACKGROUND OF THE INVENTION

1. Field of the Invention

This invention pertains to closures, and more particularly to closures for fragile containers in which is found an accumulation of pressurized free gas.

2. Description of the Prior Art

The modern carbonated beverage is composed of carbonated water, a sweetning agent, acid, flavor, color, and a preservative. The characteristic pungent taste or "bite" associated with carbonated beverages is contributed by carbon dioxide solute, which also inhibits the growth of bacteria. In addition to the solute form, carbon dioxide is usually found along with air as a free gas in a space at the top of the container, typically occupying about 25 cc. of a 10 ounce bottle. The presence of the free gas creates an explosion hazard in fragile containers such as glass bottles should the bottle break, causing the glass fragments to scatter at high velocity. The danger is aggravated at high beverage temperatures at which the water solubility of carbon dioxide is reduced and free gas is driven out of solution to add to the explosive energy, which energy is a function of free gas quantity and pressure. It has proven mechanically difficult to completely fill the bottle and thus remove the free gas, and even if this was accomplished thermal expansion of the beverage within could rupture the bottle should it and its contents become heated. Thermal expansion is not an urgent problem in containers with a relatively large volume of free gas, as 10 ounces of water will expand by only about 5 cc. when heated from 32° to 140° F., the maximum opposite temperature extremes usually encountered by carbonated beverages, and by about 4.5 cc. from room temperature of 70° to 140° F. It becomes critical, however, at the small free gas volumes associated with completely or nearly completely filled containers.

Bottle closures are known to the art that provide means for relieving free gas pressure build-up inside a bottle, such as flexible membranes or bellows for expanding the volume available to the gas under pressure. These closures, however, do not attack the basic safety problem created by the mere existence of a significant quantity of free gas in a fragile container, even at normal temperatures.

SUMMARY OF THE INVENTION

The present invention contemplates a closure apparatus for closing a container for gassy liquids such as carbonated beverages so as to effectively overcome the explosive tendencies encountered in the prior art, even at the extremes of temperature to which the container and liquid may reasonably be expected to undergo, and also to allow for thermal expansion of the liquid without endangering the integrity of the container. Moreover, to the extent the explosion hazard can be totally eliminated, thinner container material can be used with a consequent savings in material cost.

In the accomplishment of these purposes, a closure is provided with a volumetric member extending into the interior of the container when the closure is engaged on the container orifice. The member is of a size such that most if not all of the free gas is displaced from the container when it is introduced therein, and the potential explosive tendency is reduced in proportion to the amount of free gas purged.

In addition to the direct lowering of explosive energy described, the aforesaid reduction of free gas to a small amount brings about an effect whereby subsequent heating of the container and contents, rather than aggravating the danger as in the prior art, actually works to further lessen the explosive energy inside the container. This may be understood by observing that although the solubility of gas in the gassy liquid decreases with increasing temperature of the gassy liquid, such increasing temperature also causes thermal expansion of the liquid, which reduces the volume available for the free gas, thus increasing free gas pressure and the resultant tendency for the free gas to return into solution. In prior bottled beverages with about 25 cc. free gas space in a 10 ounce container the variation of solubility with temperature is the dominant effect. Water solubility of $CO_2$ decreases by a factor of about 0.52 from 32° to 70° F. room temperature, and by a factor of 0.41 from 70° to 140° F.; approximately 79% of the $CO_2$ solute will be driven out of solution as the liquid is raised from the lower to the upper temperature extreme to increase the quantity of free gas available for an explosion.

Counteracting this tendency is an increasing tendency for gas to return into solution with rising temperatures produced by increased free gas pressures resulting from liquid thermal expansion and a consequent reduction in the amount of space available for the free gas. Solubility over the expected pressure range is approximately proportionate to free gas pressure. It can therefore be seen that a liquid thermal expansion of 5 cc. will increase the free gas pressure only about 20% in currently available containers, an amount insufficient to offset the decrease in solubility from beverage temperature rise, and that both quantity and pressure of the free gas will therefore increase with rising temperatures. With the present invention however, free gas space is reduced by the introduction of the volumetric member into the container to a volume at which thermal expansion of the liquid will have a large percentage effect on the amount of free gas space. The reduction in gas space is such that the increased free gas pressure is more than enough to overcome the decrease in solubility due to temperature rise and to produce a net flow of free gas into solution. Once in solution the gas is effectively removed from contributing to an explosion; it is capable of exerting a static pressure within the liquid solvent, but an explosion occurs too fast for the dissolved gas to act as a propellant. The invention contemplates reducing the free gas space to a level so low that substantially all free gas will be eliminated and explosive energy reduced substantially to zero at a temperature no greater than the highest normally encountered temperature, which for carbonated beverages is about 140° F. All free gas may be purged from the container at the time the volumetric member is introduced if the member is sufficiently large; it is also permissible to leave a small amount of free gas in the containers whereby the above-described reduction in explosive energy takes place should the liquid be heated.

In lieu of purging free gas from the container, the free gas may be confined by using a volumetric member which is a walled, hollow compartment having a small opening accessible to free gas in the container, in which case the amount of gas if any available for an explosion is forced through the opening into the compartment as the liquid thermally expands, rather than being absorbed into solution. The opening should be small enough to throttle passage of gas therethrough in the event of container breakage.

When the free gas is purged rather than confined, although the danger of an explosion is removed, a substantially complete elimination of free gas as described creates a danger of container rupture should the liquid be subjected to additional heating and expansion. This danger is met by forming the volumetric member from a material so as to be compressible at applied pressure greater than the internal gaseous equilibrium pressure of the gassy liquid, whereby the member will compress and provide expansion room for the liquid before the container ruptures. The member may have a hollow compartment with thin, flexible walls, permissibly vented to allow gas escape under compression, or may be formed from a compressible cellular substance. The volumetric member may also constitute a hollow compartment with a small opening to admit liquid therein under expansion pressures after substantially all free gas has been removed from the container.

The closure is provided with means either independent of or integrated with the volumetric member for sealing the container orifice, which means maintains the member in spatial relation to the container.

Further objects and features of the present invention will appear from the ensuing detailed description and accompanying drawings.

DRAWINGS

DETAILED DESCRIPTION OF THE INVENTION

Figure 1:
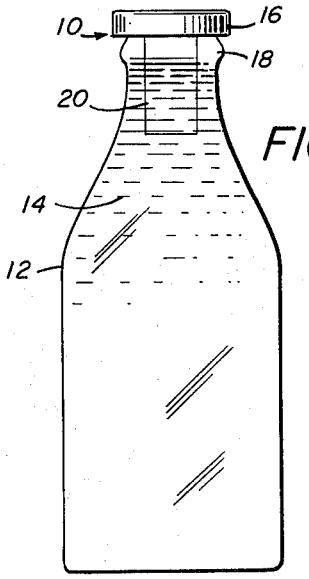
FIG. 1 is a view in frontal elevation of one embodiment of the explosion preventing closure of this invention as it would appear engaged in a transparent glass container filled with a carbonated beverage.

According to the present invention a closure generally indicated by reference numeral 10 is provided as illustrated in FIG. 1 to render a glass or other fragile container 12 non-explosive when it is filled with a gassy liquid 14 such as a carbonated beverage. The closure has a sealing portion 16 for sealably engaging the container's 12 outlet orifice 18, and a volumetric member 20 extending from the sealing portion 16 down through the orifice 18 into the interior of the container 12.

The closure 10 is set on the container 12 after the liquid 14 has been poured in by guiding the volumetric member 20 through the orifice 18 and into the container 12. If the container 12 has not been completely filled with liquid 14, a volume of free gas will be left at the top. For purposes of this invention free gas is defined as gas within the container 12 that is immediately available to contribute explosive energy should the container 12 break. Displacement of the free gas from within the container 12 is facilitated by the lateral dimension of the volumetric member 20 being somewhat smaller than the inside orifice 18 diameter, or by providing vertical grooves (not shown) on the surface of the volumetric member 20.

The size of the volumetric member 20 is such that most if not all of the free gas is purged from the container 12 when it is introduced therein, with a corresponding decrease in potential explosive energy. It is to be understood that, while a total olimination of free gas will reduce the potential explosive energy to zero, significant reductions in explosive energy at a given temperature can be achieved in proportion to the amount of gas eliminated without total elimination. In normal bottles of carbonated beverages making use of the principles of this invention, the free gas volume will never exceed 5 cc.. It is another feature of the invention that even if some free gas is left when the container 12 is closed, thermal expansion of the liquid will cause the gas to be progressively removed from the free state as the liquid temperature rises, and in the preferred embodiment substantially all free gas is removed at a temperature no greater than the highest temperature it would normally be expected to encounter, which for bottles carbonated beverages is about 140° F.

Figure 2:
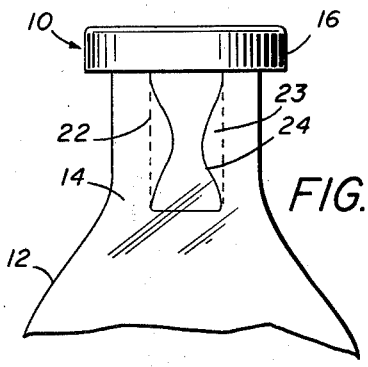
FIG. 2 is an enlarged view in frontal elevation showing an embodiment of the invention in which a volumetric member has been compressed to relieve pressure on the container walls from liquid thermal expansion.
Figure 3:
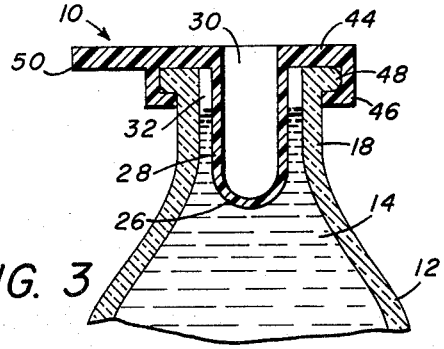
FIG. 3 is an enlarged cross-sectional view of another form of compressible volumetric member.

The volumetric member 20 is adapted to relieve pressure on the container walls should the liquid 14 be heated beyond the point at which substantially all free gas is eliminated. In FIG. 2 an embodiment is shown in which an originally cylindrically shaped volumetric member, the original shape of which is indicated by the dashed lines 22, has been compressed by liquid thermal expansion pressures to an hourglass shape 24. FIG. 3 shows in cross-section another compressible cylindrical volumetric member being hollow with a rounded lower end 26 and thin deformable walls 28. Any suitably deformable material that does not produce an adverse reaction with the gassy liquid 14 may be used. 0.035 inch low density polyethylene is a representative example, although the grade and thickness may be changed to produce a material with equally acceptable deformation properties. As the liquid 14 expands under the application of heat, the additional pressure compresses the volumetric member; consequent liquid flow into the space 23 vacated by the volumetric member 22, 24 relieves pressure against the container 12. While there is still free gas present deformation of the member will lag the liquid expansion, and the pressure relief and free gas elimination mechanisms will operate concurrently. When the container 12 is fully flooded member deformation is substantially equal to subsequent liquid expansion.

The volumetric member of FIG. 3 is vented to the outer atmosphere through an opening 30 in the closure to maintain the gas pressure within the member at atmospheric as it is compressed. In the compressible embodiment a major portion of the compressible surface area is contacted by the liquid 14 so as to be able to receive excess thermal expansionary pressures. Although a hollow, flexible-walled member is illustrated in the drawings, any compressible structure with the proper deformation characteristics, such as a solid member formed from a compressible cellular substance of which foam rubber is an example, may be used.

As shown in FIG. 3 a small free gas space 32 has been left in the container 12. The volumetric member will begin to deform until the liquid 14 has been heated sufficiently to expand into this space 32, which in the preferred embodiment is sufficiently small that substantially all free gas will be eliminated by the time the liquid 14 is heated to its highest normally expected temperature. In the case of carbonated beverages packaged in a 10 ounce container at room temperature of 70° F., the free gas space 32 should not exceed about 4.5 cc. at the packaging temperature. Should any free gas remain at the upper temperature limit, the volumetric member can be formed from a rigid material such as polypropylene.

Figure 4:
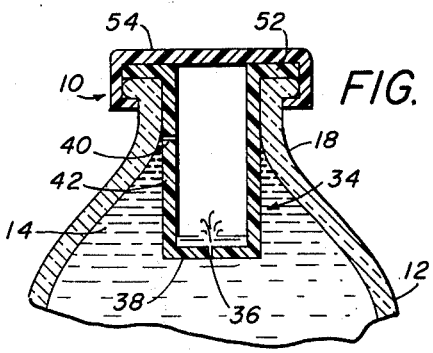
FIG. 4 is an enlarged cross-sectional view of an embodiment in which openings are provided on the walls of the volumetric member to accommodate liquid thermal expansion.

In the embodiment illustrated in FIG. 4 a wall of a hollow volumetric member 34 is provided with a small opening 36 to relieve liquid thermal expansion pressure by permitting an expansion of liquid 14 into the interior of the member. The opening 36 may be located in the bottom wall 38, in which case it is preferably small enough to permit liquid flow only at pressures greater than the internal gaseous equilibrium pressure of the liquid 14, thereby directing liquid expansion into any free gas space until a sufficiently high liquid pressure is reached. If an opening 40 is provided in the upper portion of a side wall 42, any free gas will be forced into the volumetric member 34 should the liquid 14 expand, rather than being absorbed into solution as in the previous embodiments.

Various means already known to the art for tightly sealing the container 12 may be modified to accommodate the volumetric member and employed in conjunction therewith, or the sealing means may be integrated with the volumetric member in a unitary construction. Referring now to FIG. 3, a flexible seal 44 having a skirt 46 with an annular recess corresponding to an orifice lip 48 and a pull tab 50 is joined with the volumetric member shown and snapped onto the container orifice 18. A central opening 30 communicates with and vents the interior of the volumetric member.

Figure 5:
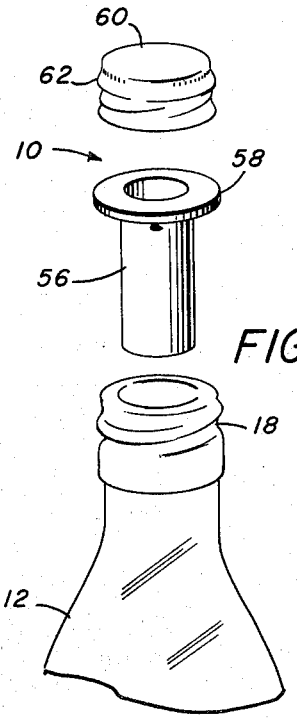
FIGS. 5 and 6 are respectively perspective and cross-sectional views detailing means associated with a volumetric member for sealing a container orifice.
Figure 6:
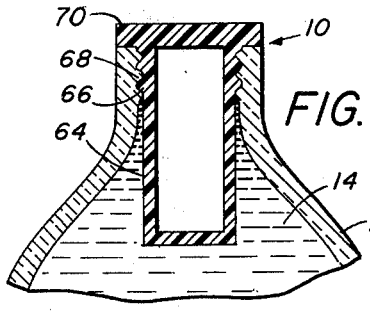

In FIG. 4 is shown a volumetric member 34 provided on the upper portion with an annular flange 52 sitting upon the orifice 18. A snap-on cap 54 engages the orifice 18 and holds the flange 52 thereon. Another sealing arrangement is shown in FIG. 5 in which a resiliently flanged volumetric member 56 similar to that of FIG. 4 but with a flange portion 58 wider than the outside orifice 18 diameter is held on a threaded orifice 18 by an inside-threaded cap 60 of aluminum or other suitable material. The overhanging flange portion captively snaps into an annular recess or groove 62 when the cap is screwed on so that the volumetric member 56 is withdrawn when the cap 54 is removed. Referring now to FIG. 6, a flanged volumetric member 64 is shown with threads on the upper depending portion 66 thereof screwed onto an inside-threaded container orifice 68. The flange 70 is sealably seated on the orifice 68.

Having now described the basic principles of my invention along with several embodiments, other variations and applications may occur to one skilled in the art. For example, although the specification has referred to packaged carbonated beverages for illustration, an aerosol bomb also exhibits a free gas explosion danger. Heretofore it has been found necessary to provide for a certain amount of free gas to compensate for thermal expansion of the aerosol. According to the present invention the potential explosive energy within an aerosol bomb may be significantly reduced by the use of a volumetric member inserted therein. As another example, other means for accommodating liquid thermal expansion such as pressure contractable bellows or accordian devices may also be envisioned. It is therefore my intention that the described embodiments be taken in an illustrative sense, and that the invention be limited only in terms of the appended claims.

I claim:

1. A non-explosive package comprising in combination a fragile container, a gassy liquid situated in and filling most of said container, an orifice in said container for dispensing said liquid, a closure for said orifice having a portion sealing said orifice against gas and liquid flow and an associated volumetric safety insert extending into said container, said safety insert occupying substantially the entire portion of the internal volume of said container not occupied by said gassy liquid when said gassy liquid is at some temperature no greater than 140° F., whereby substantially no free gas is available to contribute to an explosion of said package.

2. A non-explosive package according to claim 1, wherein said safety insert is adapted to accommodate thermal expansion of said gassy liquid and thereby relieve pressure exerted on the walls of said container by liquid expansion forces.

3. A non-explosive package according to claim 2, wherein said safety insert comprises a compressible member capable of volumetric compression under pressure and of returning to its original form upon release of such pressure, whereby pressure on the walls of said container caused by expansion forces of said liquid is relieved by expansion of said liquid into the space vacated by said member under compression, and wherein the sides of said safety insert are spaced from the inside walls of said container.

4. A non-explosive package according to claim 2 wherein said orifice is located at the upper portion of said container, said safety insert comprising a walled hollow member extending down into said container with a small opening in a wall thereof accessible to the interior of said container, said opening characterized by dimensions such as to permit a flow of said gassy liquid into said hollow member under liquid pressures greater than the normal gaseous equilibrium pressure.

5. A non-explosive package according to claim 2 wherein said safety insert comprises a compressible member capable of volumetric compression under pressure and of returning to its original form upon release of such pressure, whereby pressure on the walls of said container caused by expansion forces of said liquid is relieved by expansion of said liquid into the space vacated by said member under compression.

* * * * *